US007153377B2

(12) United States Patent
Spangler, Jr. et al.

(10) Patent No.: US 7,153,377 B2
(45) **Date of Patent: *Dec. 26, 2006**

(54) METHOD OF SEPARATING ADMIXED CONTAMINANTS FROM SUPERALLOY METAL POWDER

(75) Inventors: Charles E. Spangler, Jr., Harrison City, PA (US); William J. Murphy, Pittsburgh, PA (US)

(73) Assignee: R. J. Lee Group, Inc., Monroeville, PA (US)

( * ) Notice: Subject to any disclaimer, the term of this patent is extended or adjusted under 35 U.S.C. 154(b) by 150 days.

This patent is subject to a terminal disclaimer.

(21) Appl. No.: 10/770,317

(22) Filed: Feb. 2, 2004

(65) Prior Publication Data

US 2005/0167003 A1 Aug. 4, 2005

(51) Int. Cl.
*C22F 1/02* (2006.01)

(52) U.S. Cl. ..... 148/676; 148/674; 210/222; 210/758; 210/774

(58) Field of Classification Search ..... None
See application file for complete search history.

(56) References Cited

U.S. PATENT DOCUMENTS

| | | | | |
|---|---|---|---|---|
| 1,811,032 | A | 6/1931 | Smith et al. | |
| 3,516,612 | A | 6/1970 | Fullman et al. | |
| 3,544,309 | A | 12/1970 | Fletcher et al. | |
| 3,607,236 | A * | 9/1971 | Brooks et al. | 423/54 |
| 3,926,789 | A | 12/1975 | Shubert | |
| 3,953,252 | A | 4/1976 | Levin et al. | |
| 3,960,617 | A | 6/1976 | Levin et al. | |
| 4,054,513 | A | 10/1977 | Windle | |
| RE30,360 | E | 8/1980 | Shubert | |
| 4,230,750 | A | 10/1980 | Yurasko, Jr. | |
| 4,259,296 | A | 3/1981 | Hennion et al. | |
| 4,312,684 | A | 1/1982 | Chraplyvy et al. | |
| 4,318,735 | A | 3/1982 | Mishima et al. | |
| 4,318,757 | A | 3/1982 | Horimoto et al. | |
| 4,347,086 | A | 8/1982 | Chraplyvy et al. | |
| 4,377,410 | A | 3/1983 | Thomas et al. | |
| 4,608,093 | A | 8/1986 | Umemura et al. | |
| 4,909,865 | A | 3/1990 | Nakagawa et al. | |
| 5,062,904 | A | 11/1991 | Yoden | |
| 5,749,939 | A | 5/1998 | Kundrat | |
| 6,447,571 | B1 | 9/2002 | Ito et al. | |
| 2002/0144753 | A1 | 10/2002 | Yoshimura et al. | |

OTHER PUBLICATIONS

U.S. Appl. No. 10/420,126, filed Apr. 22, 2003, Spangler et al.

* cited by examiner

*Primary Examiner*—John P. Sheehan
(74) *Attorney, Agent, or Firm*—Arnold B. Silverman; Eckert Seamans Cherin & Mellott, LLC

(57) ABSTRACT

A method is provided for separating superalloy metal powder from contaminants, such as process-produced contaminants, by enhancing the magnetic properties thereof in a carburizing atmosphere followed by magnetic separation of the contaminants from the superalloy metal powder to thereby enhance the concentration of the contaminants. Heating or mechanical agitation or both are employed to resist agglomeration of the metal powder before magnetic separation thereof from the contaminants. Certain preferred times and temperatures are disclosed.

30 Claims, No Drawings

METHOD OF SEPARATING ADMIXED CONTAMINANTS FROM SUPERALLOY METAL POWDER

BACKGROUND OF THE INVENTION

1. Field of the Invention

The present invention relates to an improved, safe and reliable method of separating a superalloy metal powder from contaminants, such as process-produced contaminants.

2. Description of the Prior Art

It has been known in connection with powder metal product manufacture to monitor and separate contaminants therefrom in order to produce higher quality products from the metal powder. It has also been known to employ quality assurance methods wherein it is desired to detect and characterize process-produced contaminants for superalloy metal powders as a means for enhancing the quality of product made therefrom particularly in products wherein the consequences of failure are particularly serious.

It has been known to detect and characterize the concentration of process-produced contaminants by first concentrating the processed-produced contaminants by heavy liquid separation processes, such as those employing thallium malonate formate, into an aliquot which was subsequently examined by microscopy methods. This process separates the metal powder which may have a density of about 8.0 grams/cm$^2$ from oxides which may have a density of about 4.0 grams/cm$^2$ or less as a result of the density differences. It is also desired in such processes to increase the volume of the processed powder metal sample in order to improve the statistical reliability of the microscopy methods.

A serious problem with the use of thallium malonate formate is that it is potentially hazardous. It requires the services of specially trained technicians as well as continuous monitoring of the technicians' exposure levels, special laboratory handling equipment and special disposal methods. Further, it has a limited batch size which may be about ¼ pound, and a process time of about one batch per eight-hour shift, for example. The small batch size limits the accuracy of the quality assurance analysis for detecting process-produced contaminant particles. Further, these negative factors contribute directly or indirectly to increased overall costs of the quality assurance process.

It has been suggested to employ two-stage oxidation of the surface of metal particles which consists mainly of iron and an oxidation environment at an elevated temperature in order to enhance stability of the metal particles. See, for example, U.S. Pat. No. 4,318,735. See also U.S. Pat. No. 4,608,093 which discloses gradual oxidation of ferromagnetic particles in order to create a stable oxide coating that will resist deterioration under the influence of temperature and humidity. The heating is said to occur in two stages at temperatures up to 150° C.

U.S. Pat. No. 4,909,865 discloses a ferromagnetic metal powder composed mainly of iron which is provided with an oxide coating for uses in magnetic recording media.

U.S. Pat. No. 5,062,904 discloses the processing of ferromagnetic particles which are said to be provided with enhanced storage stability through oxidation of the surface under the influence of plasma in an oxygen atmosphere.

U.S. patent Publication No. 2002/0144753 discloses a method of producing a rare earth metal-based permanent magnet having a thin film layer through placing the rare earth permanent magnet and a fine metal powder forming material into a treating vessel and vibrating them and agitating them.

U.S. Pat. No. 3,516,612 discloses the resistance to forming of clumps or aggregates in fine particles for a magnetic material due to a combination of an imposed magnetic field and mechanical agitation such as, by mechanical brushing of the powder.

U.S. application Ser. No. 10/420,126, in which the present inventors are coinventors, is hereby expressly incorporated by reference. It discloses separation of superalloy metal powder from contaminants by enhancing the magnetic properties of the superalloy as by oxidizing or leaching of chromium at elevated temperature followed by magnetic separation of the contaminants from the superalloy metal powder. Mechanical agitation during heating is disclosed as a means for resisting agglomeration of the metal powder prior to magnetic separation.

In spite of the foregoing disclosures, there remains a very real and substantial need for reliable, safe, accurate and low-cost methods for producing aliquots from superalloy metal powder particles which are concentrated with respect to contaminants, such as process-produced contaminants, and which are amenable to microscopy analysis for statistically reliable quality assurance.

Overall as a result of the foregoing limitations, there exists a very real and substantial need for a reliable, safe, accurate and lower-cost method for producing aliquots from the superalloy metal powder particles which are concentrated with respect to contaminants, such as process-produced contaminants, and which are amenable to microscopy analysis for statistically reliable quality assurance.

SUMMARY OF THE INVENTION

The present invention has met the hereinbefore described needs.

The present invention involves replacing the heavy liquid separation process with a two-stage process which consists of a pre-treatment of a sample of the metal powder product to enhance the separability of the metallic and contaminant constituents followed by a safe and reliable, conventional separation process. The two-stage process involves heating the metal product powder to selectively enhance the magnetic susceptibility of the metal particles followed by magnetic separation.

In one embodiment of the invention, a method of separating nickel-based superalloy metal powder from non-magnetic contaminants includes heating the superalloy metal powder in the presence of a carburizing atmosphere to establish enhanced magnetic permeability, and thereby enhance the magnetic permeability of the superalloy metal powder followed by magnetic separation of the metal powder from the contaminants.

In a preferred embodiment of the invention, in order to resist undesired agglomeration of the metal powder, solid particles of carbon are mixed with the metal powder. In this embodiment, the carbon particles serve as a barrier to metal-to-metal contact during heating and also as a reactant to form a carburizing gas.

It is preferred in order to resist undesired agglomeration of the metal powder particles through appropriate choice of heating conditions or through mechanical agitation or both to provide resistance to agglomeration among the metal powder product particles during the separability enhancement stage.

In one embodiment, the separability enhancement stage preferably occurs at a temperature in the range of about 700–1000° C. and preferably is in the range of about 800–1000° C. and, more preferably, about 900–1000° C.

The time at temperature in the presence of a carburizing atmosphere may be about 0.5 to 24 hours. The time depends upon the temperature with longer times such as 12 to 24 hours, for example, used for a temperature of about 800° C. and shorter times, such as 0.5 to 2 hours or less, for example, used for a temperature of 900° C. to 1000° C. The heating to resist agglomeration without mechanical agitation, preferably, is at the lower temperatures such as about 700–900° C. Agglomeration is preferably minimized or prevented at essentially all temperatures by using mechanical agitation.

It is an object of the present invention to provide a reliable, safe, accurate and lower-cost method of producing aliquots from superalloy metal powders which are concentrated with respect to the non-magnetic contaminants admixed therewith.

It is another object of the present invention to provide such a method which employs enhancement of the magnetic properties of the superalloy metal powder to facilitate production of aliquots which are concentrated with respect to the contaminants.

It is another object of the present invention to provide means for resisting agglomeration of the metal powder product particles during enhancement of magnetic properties during alteration of the metallic phases.

It is another object of the present invention to provide means for resisting agglomeration of the metal powder product particles during carburization of the metal particles.

It is a further object of the present invention to provide such a system which is readily and advantageously employed in effective quality assurance processes.

It is yet another object of the present invention to provide such a method which does not require the use of highly skilled technical individuals.

It is a further object of the present invention to provide such a method which resists adding extraneous contaminants to the superalloy metal powder and contaminant mixture.

DESCRIPTION OF THE PREFERRED EMBODIMENTS

As employed herein, the term "carburizing" refers to a method of adding and diffusing carbon into the surface of metals and alloys by heating in the presence of a solid, liquid or gaseous carbon source.

As employed herein, the term "carburizing atmosphere" refers to an atmosphere wherein the degree of carburizing desired for the process can take place. An example of such an environment would be a closed furnace or a suitable container having the superalloy powder and the carburizing atmosphere which will provide the amount of carbon needed for carburizing the superalloy powder. The process may be performed on a batch basis or by having a suitable conveying apparatus on a continuous basis.

A preferred use of the method of the present invention is in connection with the quality assurance evaluation of nickel-based superalloy powders which may have a size on the order of less than about 60 microns, and related contaminants which may be powder-manufacturing-process-produced contaminants having a size of less than about 100 microns. These include, but are not limited to compositions in the range, on a weight percent basis, of about 12 to 16.5% Cr, 7 to 13.5% Co, 3.3 to 4.2% Mo, 3.3 to 4.2% W, 0.6 to 3.7% Nb, 2.3 to 3.9% Ti, 1.9 to 3.7% Al, 0.01 to 0.06% C, 0.006 to 0.025% B, 0.03 to 0.5% Zr with the balance being nickel and tolerable impurities. In order to enhance the efficiency of quality assurance operations, it is desired to create an effective separation of the contaminants from the metal powder.

Such contaminants may be present in amounts of 10 parts per million (ppm) or less.

It will be appreciated that for certain end uses of the superalloy metals, such as in aircraft engines, for example, for both safety and economic reasons it is critical that the superalloy powder have the required purity with respect to even very low levels of contaminants.

In quality assurance programs employed to cull materials with unacceptably high levels of contaminants, contaminants are relatively rare events. As a result, it is desirable to produce samples for quality assurance that are concentrated with respect to such contaminants.

The process-produced contaminants of concern in the present invention include, but are not limited to, oxides of silicon, zirconium, aluminum, calcium and magnesium. Among the preferred superalloy metal powders are those selected from the group consisting of non-magnetic superalloys, including nickel-containing alloys.

One embodiment of the invention involves carburizing heat treatment of the metal powder product in a carburizing atmosphere at relatively low temperatures which may be on the order of about 700 to 825° C. for about 12 to 24 hours in order to enhance the magnetic properties of the superalloy powder.

The powder is then cooled or permitted to cool to below about 300° C. and preferably to about room temperature. After that, the powder may be passed through a magnetic field to permit separation of the superalloy powder from the non-magnetic contaminants in a concentrated aliquot. Under these conditions, relatively no or low magnetic properties are achieved and magnetic separation is obtained by employing a high magnetic field such as that provided by a neodymium magnet, for example. Also, repeated cycles of operation may be employed.

A preferred embodiment of the invention involves carburizing heat treatment wherein the powder is heat treated in a carburizing atmosphere at a relatively high temperature which may be about 900 to 1000° C. Within this temperature range, the time periods are preferably lower than for the low temperature treatment and preferably range from about 0.5 to 2 hours with longer time being employed with increased temperature generally requiring less time. The treated powder is then cooled or permitted to cool to room temperature. This produces phase changes of a portion of the superalloy metal powder by way of chemical reaction with the carbon or carbon containing gas in order to enhance magnetic properties. The carburizing heat treatment is followed by magnetic separation and retrieval of non-magnetic contaminants in a concentrated aliquot.

When solid carbon is employed to produce a carburizing atmosphere in the form of carburizing gas, the process of heating may be conducted in an oxygen-bearing environment such as air or without oxygen by using an admixture of a carbon dioxide producing chemical such as $BaCO_3$ or $NaCO_3$ with the carbon. Another alternative would be to effect the carburizing heating in a prepared gaseous atmosphere containing carbon monoxide or hydrocarbons, such as methane or butane. As the contaminants are oxides, the thermal process that enhances the magnetic susceptibility of the superalloy powder does not alter them.

To resist undesirable agglomeration of the metal powders, heating may be effected for periods of about 3 to 15 minutes alternating with mechanical agitation which may be effected by a suitable means well known to those skilled in the art.

In the alternative, heating and mechanical agitation may be effected simultaneously. One method of mechanical agitation can involve vibrating the powder container or rotating the same while in the furnace at a predetermined temperature at a suitable frequency to obtain a fluid-type motion of the powder.

The metal powder product may then be subjected to magnetic separation of the magnetically more susceptible metal particles by any suitable means, such as, transporting the powder through a magnetic field of appropriate strength. In this manner, the contaminants such as process-produced contaminants will have increased concentration resulting from separation of the superalloy metal powder.

While certain preferred methods of enhancing magnetic properties have been disclosed, it will be appreciated that effective magnetic enhancement may be accomplished in these embodiments within the range of about 700 to 1000° C. and preferably about 900 to 1000° C. for about 0.5 to 24 hours with shorter time periods being employed for higher temperatures.

In order to provide additional understanding of the invention, several examples will be considered.

In these examples, nickel-based superalloy metal powders with a particle size of −270 mesh were used. Superalloy powder such as this is not ferromagnetic, is weakly paramagnetic and thus has very low magnetic susceptibility. The carburizing atmosphere was achieved by the use of graphite powder, which in appropriate amounts was thoroughly and uniformly mixed with the superalloy powder, or by the use of a carburizing gas. When mechanical agitation of the powder was used during heat treatment, it was accomplished by either vibrating the Inconel crucible containing the powder/graphite mixture or by rotating the container disposed at an angle of about 45° to the horizontal in the furnace. After heat treatment, the magnetic permeability was evaluated by exposing the powder to the influence of a strong permanent magnet. Depending upon the response of the powder, permeability was rated as being (a) very strong, (b) strong, (c) moderate, or (d) weak.

The superalloy metal powder had a nominal composition, on a weight percent basis, of 14% Cr, 8% Co, 3.5% Mo, 3.5% W, 2.0% Nb, 3.5% Ti, 3.5% Al, 0.065% C, 0.01% B, 0.05% Zn with the balance being nickel.

EXAMPLE 1

Superalloy powder mixed with 4.4% graphite powder (on a weight basis) with a particle size of less than one micron was heated in air for a total of 1 hour at 900° C. without mechanical agitation and cooled to room temperature. After heat treatment, the superalloy metal powder exhibited strong magnetic susceptibility. However, substantial agglomeration of the powder was also observed.

EXAMPLE 2

Superalloy powder mixed with 4.4% graphite powder was heated in air for a total of 1 hour at 900° C. and cooled to room temperature. During heat treatment, the powder container was rotated, to mechanically agitate the powder. After heat treatment the powder exhibited strong magnetic susceptibility and little or no agglomeration of the powder was observed.

EXAMPLE 3

Superalloy powder with 2.9% graphite powder was heated in air for a total of 2 hours at 900° C. and cooled to room temperature. During heat treatment, the powder was mechanically agitated as indicated in Example 2. After heat treatment, the powder exhibited very strong magnetic susceptibility and little or no agglomeration of the powder was observed.

EXAMPLE 4

Superalloy powder with 4.3% graphite was heated in air at 800° C. and cooled to room temperature while being mechanically agitated. Three different times at temperature were used: 1 hour, 2 hours, and 12 hours. After heat treatment, the powder exhibited weak but significant, strong, and very strong magnetic susceptibility, respectively. Agglomeration levels were low for all heat treatments.

EXAMPLE 5

Superalloy powder with 2.9% graphite was heated in air for a total of 1 hour at 1000° C. while being mechanically agitated and cooled to room temperature. After heat treatment, the powder exhibited very strong magnetic susceptibility. Little or no agglomeration of the powder was observed.

EXAMPLE 6

Superalloy powder containing 2.9% graphite and 0.5% barium carbonite was heated for a total of 2 hours at 900° C. and cooled in air while being mechanically agitated. The Inconel crucible containing the powder mixture was capped with a tightly fitted lid to resist ingress of air during heat treatment. After heat treatment, the superalloy powder exhibited weak, but significant magnetic susceptibility. Little or no agglomeration of the powder was observed.

EXAMPLE 7

Superalloy powder was heated for a total of 1 hour at 900° C. in a carburizing gas atmosphere of 39.8% $N_2$, 20.7% CO, 38.7% $H_2$ and 0.8% $CH_4$ After heat treatment, the superalloy powder exhibited very strong magnetic susceptibility. However, because no mechanical agitation was employed, severe agglomeration was observed.

EXAMPLE 8

Superalloy powder containing 2.9% graphite, seeded with 27 non-metallic contaminants with a particle size of less than 200 microns, and weighing 114.9 grams was heated for a total of 2 hours at 900° C. and cooled to room temperature while being mechanically agitated. After heat treatment, the powder was spread out to a depth approaching several powder layers in a non-magnetic stainless steel pan. A three-inch diameter, neodymium magnet was then passed several times slowly over the bed of powder while maintaining an air gap decreasing from about 2 inches to less than ¼ inch with successive passes. After magnetic separation, only 0.047 grams of powder remained and the 27 seeds were readily recovered.

The method of the present invention may be practiced in a closed vessel in a batch basis or may be practiced on a continuous basis by providing suitable conveyor means through the treatment zones along with appropriate seals.

It will be appreciated that the present invention has provided a safe, enhanced reliable method of effecting separation of contaminates, such as process-produced contaminants, from superalloy metal powders through enhancing the magnetic susceptibility of the metallic particles and thereby facilitating magnetic separation thereof. The invention provides, thereby, the means for detecting and characterizing the concentration of process-produced, non-metallic contaminants for quality control and quality assurance purposes.

While specific embodiments of the invention have been described in detail, it will be appreciated by those skilled in the art that various modifications and alternatives to those details could be developed in light of the overall teachings of the disclosure. Accordingly, the particular embodiments disclosed are meant to be illustrative only and not limited as to the scope of the invention which is to be given the full breadth of the appended claims and any and all equivalents thereof.

The invention claimed is:

1. A method of separating superalloy metal powder from non-magnetic contaminants admixed therewith comprising, enhancing the magnetic response of such superalloy metal powder in a carburizing atmosphere, and magnetically separating said metal powder from said contaminant.

2. The method of claim 1, including employing heating to effect said enhancing the magnetic response of the metal powder.

3. The method of claim 2, including effecting said heating at about 700 to 1000° C. for about 0.5 to 24 hours.

4. The method of claim 3, including effecting said heating of about 900 to 1000° C. for about 0.5 to 2 hours.

5. The method of claim 3, including subsequent to said heating, cooling said metal powder to below about 300° C.

6. The method of claim 1, including employing graphite to produce said carburizing atmosphere.

7. The method of claim 6, including employing said graphite as a powder.

8. The method of claim 2, including resisting agglomeration of said metal powder and contaminant particles during heating and prior to said magnetic separation of the admixture.

9. The method of claim 8, including resisting agglomeration by agitating said metal powder and contaminant.

10. The method of claim 8, including resisting agglomerating by a combination of predetermined time, temperature and fumace atmosphere conditions.

11. The method of claim 8 including effecting said resisting of agglomeration by admixing solid carbon particles with said superalloy metal powder.

12. The method of claim 1, wherein said means of enhancing the magnetic response of the metal powder includes altering the phases of the metallic particles.

13. The method of claim 1, including employing said method on said contaminants which are process-produced contaminants.

14. The method of claim 1, including employing said method on said contaminants which are process-produced contaminants.

said process-produced contaminants including at least one material selected from the group consisting of oxides of silicon, aluminum, zirconium, calcium and magnesium.

15. The method of claim 1, including employing said method on said contaminants which are process-produced contaminants.

said process-produced contaminants having a particle size less than about 100 microns.

16. The method of claim 1, including said metal powder having a particle size of less than about 60 microns.

17. The method of claim 1, including employing said method on said contaminants which are process-produced contaminants, said initial process-produced contaminants having a size less than about 100 microns and a concentration of 10 ppm or less.

18. The method of claim 1, including employing a superalloy which is a nickel-based superalloy.

19. The method of claim 1, including employing said process as part of a quality assurance process.

20. The method of claim 1, including employing said process to produce aliquots of metal powder products which are concentrated with respect to said contaminants.

21. The method of claim 1, including employing said magnetic field produced by a neodymium magnet.

22. The method of claim 21, including repeating said method for a plurality of cycles on a batch of said superalloy metal powder.

23. The method of claim 1, including performing said process on a batch basis.

24. The method of claim 6, including producing a carburizing gas from solid carbon particles by heating in an environment selected from the group consisting of (a) an oxygen-bearing environment and (b) a carbon dioxide producing material.

25. The method of claim 1, including employing in said carburizing atmosphere a material selected from the group consisting of hydrocarbons and carbon monoxide.

26. The method of claim 8, including effecting said resistance of agglomeration by said heating.

27. The method of claim 2, including resisting agglomeration of said metal powder by both heating and mechanical agitation.

28. The method of claim 1, including performing said process as a substantially continuous process.

29. The method of claim 7, including employing said graphite powder in an amount of about 2.9 to 4.4 weight percent of said metal powder.

30. The method of claim 1, including establishing said carburizing atmosphere by a carburizing gas.

* * * * *